United States Patent [19]

Harper, Jr.

[11] 4,297,825

[45] Nov. 3, 1981

[54] STRUT FOR SPACE FRAMES

[75] Inventor: George C. Harper, Jr., Coraopolis, Pa.

[73] Assignee: Pittsburgh-Des Moines Corporation, Pittsburgh, Pa.

[21] Appl. No.: 120,844

[22] Filed: Feb. 12, 1980

[51] Int. Cl.[3] ..... E04B 1/32

[52] U.S. Cl. ..... 52/729; 52/81; 52/463; 52/467; 52/730

[58] Field of Search ..... 52/222, 63, 467, 81, 52/463, 472, 729, 730; 135/15 CF, 1 R; 160/395, 397

[56] References Cited

U.S. PATENT DOCUMENTS

| | | | |
|---|---|---|---|
| 1,802,835 | 4/1931 | Roberts | 52/222 |
| 1,987,860 | 1/1935 | Milone | 160/395 |
| 3,080,875 | 3/1963 | Bartlett | 135/1 R |
| 3,263,385 | 8/1966 | Pauls | 52/467 |
| 3,398,496 | 8/1968 | Mischke | 52/467 |
| 3,909,994 | 10/1975 | Richter | 52/63 |
| 3,959,937 | 6/1976 | Spunt | 52/81 |
| 4,193,235 | 3/1980 | Cucchiara | 52/222 |

FOREIGN PATENT DOCUMENTS

| | | | |
|---|---|---|---|
| 1007949 | 4/1977 | Canada | 52/63 |

*Primary Examiner*—John E. Murtagh

*Attorney, Agent, or Firm*—Shoemaker and Mattare, Ltd.

[57] ABSTRACT

A roof strut permits easy attachment of roof covering material thereto. The strut has a channel defined therein and a clamping bar is positioned within the channel to sandwich roof covering material between that bar and the strut to form a gasketless seal.

6 Claims, 4 Drawing Figures

STRUT FOR SPACE FRAMES

BACKGROUND OF THE INVENTION

The present invention relates in general to building structures, and, more particularly, to building structural support elements and coverings used in space frames, such as geodesic domes, or the like.

Many buildings have sheeting type coverings for the roofs thereof. Such sheeting must prevent moisture from entering the building, but also should be as easy as possible to install.

Prior art roof coverings are often difficult to install and often require special tools and specially skilled personnel to effect the roof covering installation. Gaskets and other such sealing elements are usually required. Such special requirements increase the cost of building construction, increase the time required to erect the building, and may even reduce the integrity of such buildings. The drawbacks are especially important in buildings having geodesic dome type roofs.

Accordingly, there is need for a building roof which can have any roof covering used therefor easily and quickly installed without requiring special tools and/or skills and which does not require gaskets to effect a secure seal.

SUMMARY OF THE INVENTION

The roof structure embodying the teachings of the present invention has means for permitting easy and secure roof covering installation, and does not require special tools or special skills to effect a secure installation. The sheeting can be installed without need of any gaskets between that sheeting and the roof structural elements supporting that sheeting.

The device of the present invention is especially applicable to space frames, and such application is the preferred embodiment. However, those skilled in the art will recognize other applications based on the description presented herein. Thus, while space frames will be disclosed herein, no limitation is intended thereby. It is also noted that terms such as "top" and "bottom" are terms of convenience, and no limitation is intended thereby.

A strut has a longitudinal channel defined therein with a fastening slot extending the length of that strut. A clamping bar having a corrugated bottom and a plurality of fastener receiving holes defined therein is received in the channel. The channel has ridges which are located adjacent lands located between the corrugations of the clamping bar.

Sheeting is crimped between the clamping bar and the channel bottom to attach that sheeting to the strut. A gasketless seal is formed.

Fasteners, such as screws, or the like, are used to attach the clamping bar to the strut, and thus no special tools or skills are required to quickly, easily and securely attach the sheeting to the strut.

OBJECTS OF THE INVENTION

It is a main object of the present invention to quickly, easily and securely attach sheeting to a roof strut.

It is another object of the present invention to quickly, easily and securely attach sheeting to a roof strut without need of gaskets.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
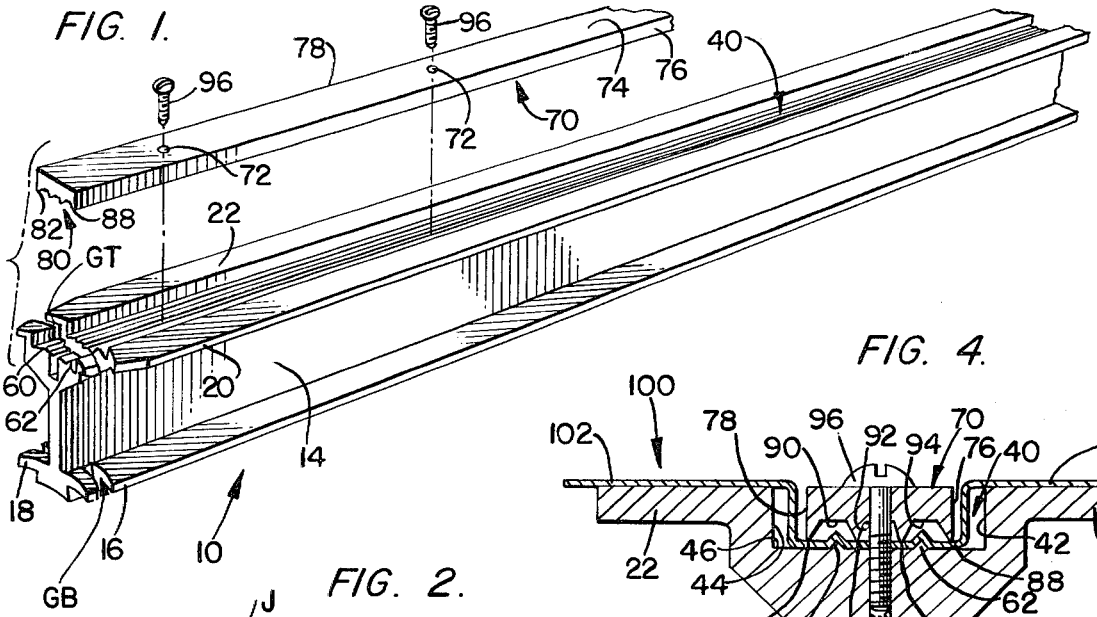
FIG. 1 is a perspective showing a roof strut embodying the teachings of the present invention.
Figure 3:
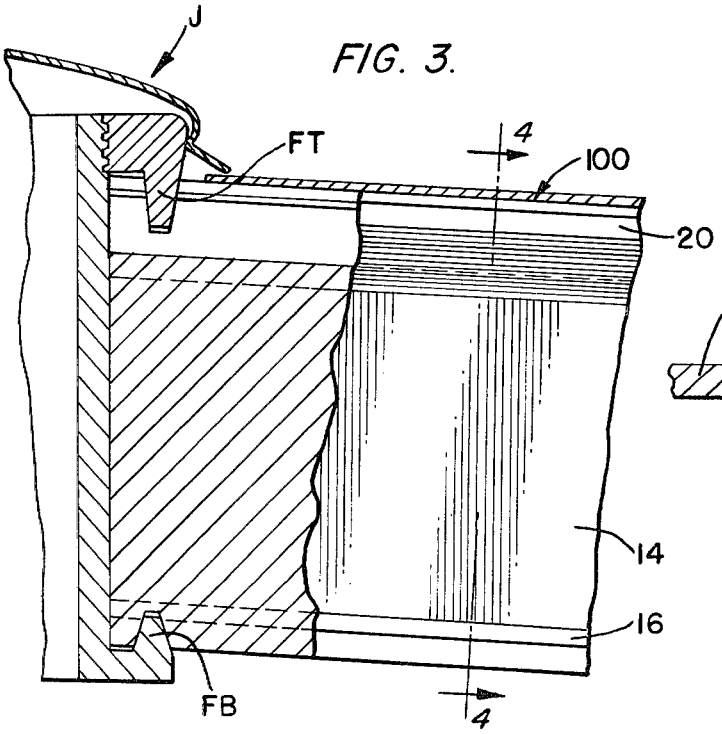
FIG. 3 is a view taken along line 3—3 of FIG. 2.

Shown in FIG. 1 is a strut 10 which, in the preferred embodiment of the present invention, is used in a space frame with a joint connector J as shown in FIG. 3. The joint connector J is the subject of a co-pending patent application Ser. No. 138,526, filed on Apr. 8, 1980 by the present inventor.

Figure 2:
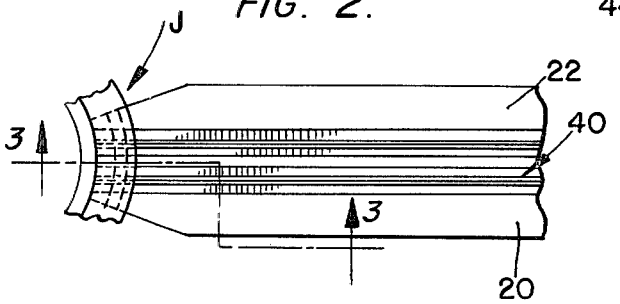
FIG. 2 is a top plan view showing a roof strut embodying the teachings of the present invention attached to a joint connector.

The strut 10 includes a web 14, a pair of co-planar lower flanges 16 and 18 and a pair of co-planar upper flanges 20 and 22 integrally connected to the web to form an I-beam configuration. A plurality of grooves GT and GB are defined transversely of the strut to accommodate flanges FT and FB, respectively, of the joint connector to attach the strut to that joint connector, as shown in FIGS. 2 and 3.

Figure 4:
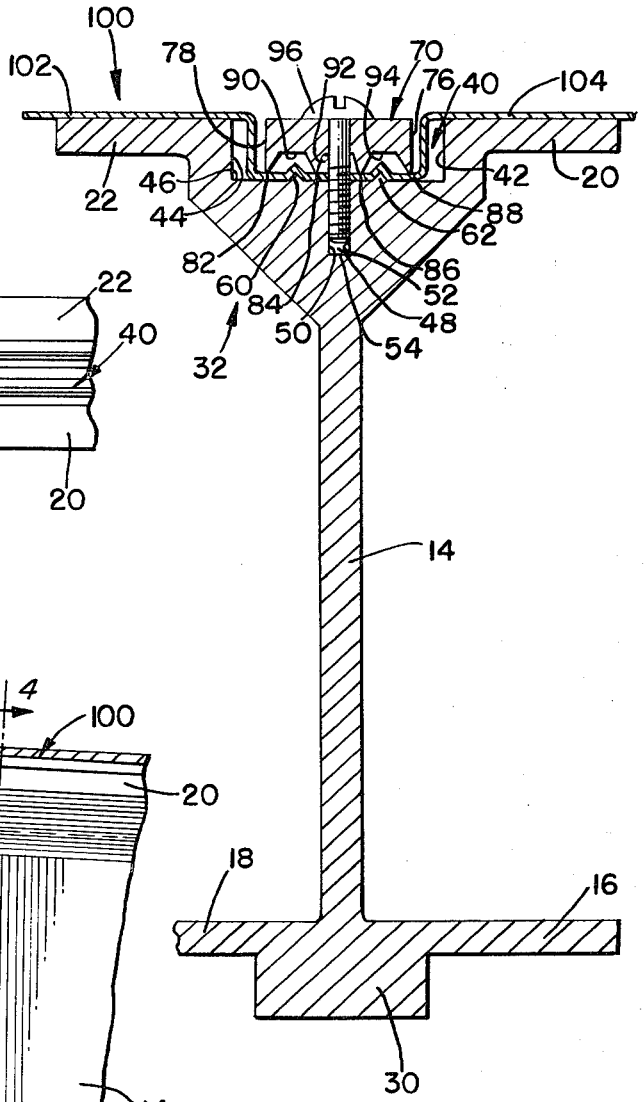
FIG. 4 is a view taken along line 4—4 of FIG. 3.

A boss 30 is defined on the strut between the lower flanges 16 and 18 and a crown section 32 is defined on the beam upper section between the flanges 20 and 22 and the web 14, as best shown in FIG. 4.

A channel 40 is defined in the strut to extend longitudinally of that strut. The channel is rectangular in transverse cross-section and extends the length of the strut. The channel is open-topped, and has inner side walls 42 and 44 which are in spaced parallelism with each other, and a bottom wall 46 extending in spaced parallelism with the top flanges 20 and 22.

A fastener slot 48 is defined in the beam crown section to extend the length of the strut. The slot 48 is open-topped and is rectangular in transverse cross-section. The slot has side walls 50 and 52 and bottom 54 which is in spaced parallelism with the channel bottom 46.

A pair of ridges 60 and 62 are defined on the channel bottom 46 to be on either side of the fastener slot and to project upwardly from the channel bottom into the channel. Preferably, the ridges are triangular in cross-section with the apeces thereof located within the channel. The ridges extend the entire length of the strut.

A clamping bar 70 is located within the channel 40. The bar 70 has a length essentially equal to that of the strut and a width slightly smaller than the width of the channel 40. The bar 70 has a plurality of spaced fastener receiving holes 72 defined longitudinally thereof. The holes 72 are positioned to be aligned with the slot 48 when the clamping bar is in a clamping position as shown in FIG. 4. The clamping bar is rectangular in transverse cross-section and has a top 74 and a pair of side walls 76 and 78. The bar 70 has a corrugated bottom wall 80 which has four ridges 82, 84, 86 and 88 extending lengthwise of the bar, and lands 90, 92 and 94 located between the ridges. The ridges are positioned to straddle the channel ridges 60 and 62 so that the channel ridges correspond to the clamping bar lands, as best shown in FIG. 4.

A plurality of fasteners, such as screws 96, or the like, couple the clamping bar to the strut via the slot 48. The slot 48 has a width selected so that the fasteners securely attach to the slot side walls 50 and 52. The slot permits easy positioning of the clamping bar as the fastener holes 72 need only be aligned with the slot transversely of the channel, and no longitudinal alignment is required.

Deck covering 100 includes a pair of deck sheets 102 and 104 which are attached to the strut 14 by the clamping bar. The deck sheets are each positioned to have one edge thereof adjacent the fastener slot 48, and the clamping bar is tightened down thereby crimping the deck sheets and attaching those sheets to the strut. The attachment of the deck sheets to the strut is secure, yet is accomplished without need of a gasket. A gasketless seal is thus formed.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A roof strut comprising:

a web;

a bottom flange connected to said web and having a first boss thereon;

a top flange having a second boss thereon, said second boss connecting said top flange to said web;

a channel defined in said top flange, said channel having a planar bottom defined by the top of said second boss;

a fastener receiving slot defined in said second boss to open into said channel;

a pair of upwardly projecting channel ridges defined on the bottom of said channel and extending for essentially the entire length of the roof strut, said channel ridges having a height substantially less than the depth of said channel;

a clamping bar sized to be loosely received in said channel, said clamping bar having a top and a bottom and including a plurality of clamping bar ridges on said bottom, said clamping bar ridges having heights greater than said channel ridges and located so that said channel ridges are located between adjacent downwardly projecting clamping bar ridges when said clamping bar is located within said channel, and fastener receiving holes defined in said clamping bar to be aligned with said fastener receiving slot so that a fastener can be used to attach said clamping bar to said second boss;

said web, bosses and flanges each having an end which is curved to correspond to the curvature of a hub of a space frame joint connector and each having an arcuate groove defined therein to receive a flange of such hub for connecting the roof strut to such hub; and said clamping bar being adapted to attach a unitary sheet of roof covering material to the roof strut while crimping that sheet and said fastener passing through that sheet so such sheet is attached to the roof strut in a secure manner.

2. The roof strut defined in claim 1 wherein the strut includes on I-beam.

3. The roof strut defined in claim 1 further including screw thread defining means in said slot.

4. The roof strut defined in claim 3 wherein said slot is located between said channel ridges.

5. The roof strut defined in claim 4 wherein said clamping bar is sized to extend for essentially the entire length of the roof strut.

6. The roof strut defined in claim 5 wherein said clamping bar ridges extend for the entire length of said clamping bar.

* * * * *